US006726454B2

(12) United States Patent
Blass et al.

(10) Patent No.: US 6,726,454 B2
(45) Date of Patent: Apr. 27, 2004

(54) FAN HAVING AXIAL BLADES

(75) Inventors: Uwe Blass, Moeglingen (DE); Christoph Kurdzel, Adelschlag (DE)

(73) Assignee: Behr GmbH & Co., Stuttgart (DE)

( * ) Notice: Subject to any disclaimer, the term of this patent is extended or adjusted under 35 U.S.C. 154(b) by 201 days.

(21) Appl. No.: 10/024,514

(22) Filed: Dec. 21, 2001

(65) Prior Publication Data

US 2002/0085912 A1 Jul. 4, 2002

(30) Foreign Application Priority Data

Jan. 2, 2001 (DE) ..... 101 000 64

(51) Int. Cl.[7] ..... F04D 29/38
(52) U.S. Cl. ..... 416/236 R; 416/237
(58) Field of Search ..... 416/169 A, 175, 416/193 R, 203, 236 A, 237, 236 R

(56) References Cited

U.S. PATENT DOCUMENTS 4,139,299 A 2/1979 Miyakawa et al. ..... 355/10
4,189,281 A 2/1980 Katagiri et al. ..... 415/213
5,984,631 A 11/1999 Tolgos ..... 415/194
6,375,427 B1 * 4/2002 Williams et al. ..... 416/169 A

FOREIGN PATENT DOCUMENTS

| | | |
|---|---|---|
| DE | 26 14 318 | 10/1976 |
| DE | 27 56 880 | 6/1978 |
| DE | 195 25 699 | 1/1997 |
| DE | 199 29 978 | 1/2001 |
| EP | 0 515 839 | 12/1992 |
| GB | 2 041 103 | 9/1980 |

* cited by examiner

*Primary Examiner*—Edward K. Look
*Assistant Examiner*—Dwayne J. White
(74) *Attorney, Agent, or Firm*—Foley & Lardner LLP

(57) ABSTRACT

An axial-flow fan (1) is arranged on a viscous coupling (4). Fin-like stabilizers (5) are provided in the region of the blade roots, that is to say in the hub region, and these fin-like stabilizers (5) segregate the hub flow and the blade flow. In addition, a radial blade element (6) can be provided and are assigned in each case to these stabilizers and can be integrated with the surface of the stabilizer (5) to form a common surface. These special flow-conducting elements can favorably influence the fan flow in its hub region in such a way as to improve the fan output.

20 Claims, 7 Drawing Sheets

FAN HAVING AXIAL BLADES

BACKGROUND OF THE INVENTION

1.) Field of the Invention

The invention relates to a fan having axial blades, in particular for radiators of motor vehicles.

2.) Description of Related Art

According to German application 199 29 978.1, filed Jun. 30, 1999 ("DE '978"), air-conducting elements are arranged in the suction-side region of the axial blades which is close to the hub. In addition, a hub ramp is arranged in the pressure-side region of the axial blade. In a preferred embodiment, the air-conducting elements extend over the entire blade spacing, that is to say from the leading edge of one axial blade up to the leading edge of an adjacent axial blade. This special embodiment of the air-conducting elements, as is shown in FIGS. 3 and 4 of DE '978, therefore forms a continuous surface, or wall, between two blades for a closed flow passage. In certain states of flow, these closed flow passages may be disadvantageous; in particular, they may lead to damming effects and vortex formations, that is to say, flow losses.

SUMMARY OF THE INVENTION

One object of the invention is to overcome the problems of the known art described above. Another object of the invention is to avoid the aforesaid damming effects resulting from closed flow passage.

To accomplish the foregoing and other objects of the invention, there has been provided according to one aspect of the invention, a fan that includes axial blades fastened to a fan hub, and air-conducting elements being arranged in the region of the hub and essentially on the suction side of the axial blades, wherein the air-conducting elements are designed as fin-like stabilizers, the extent s of which in the circumferential direction is in the range of $0.01\ t<s<0.40\ t$, t being the blade spacing. In a preferred embodiment, the fan includes a radial blade element. The radial blade element is arranged downstream of the stabilizer in the direction of rotation of the fan and within the stabilizer in the radial direction.

Further objects, features and advantages of the present invention will become apparent from detailed consideration of the preferred embodiments that follow.

BRIEF DESCRIPTION OF THE DRAWINGS

Exemplary embodiments of the invention are shown in the drawings and described in more detail below. In the drawings.

DETAILED DESCRIPTION OF THE PREFERRED EMBODIMENTS

Figure 1:
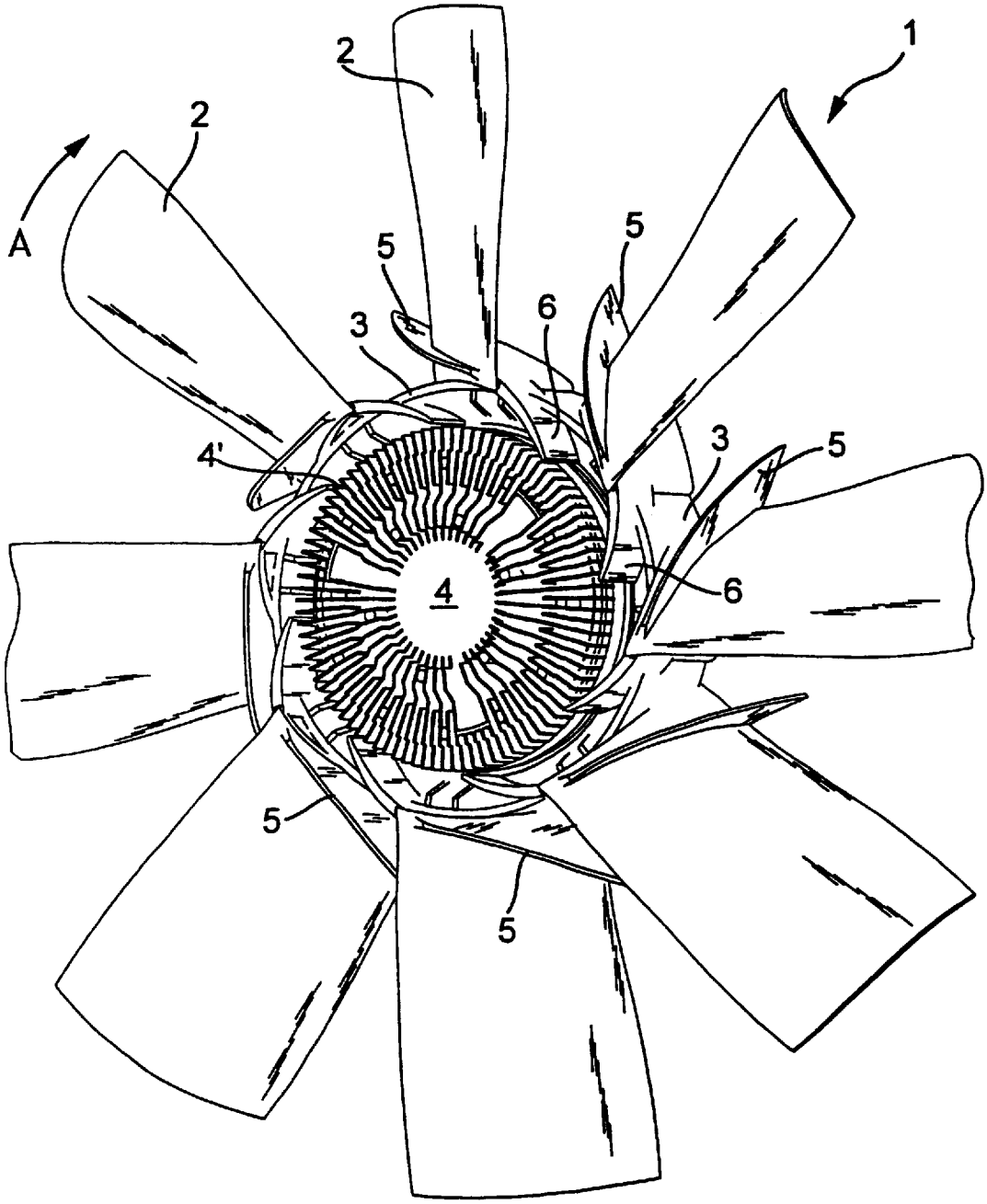
FIG. 1 shows the fan in a perspective view from the front.

The air-conducting elements of the present invention are designed as fin-like stabilizers which extend in the circumferential direction (also referred to as extent (s)) only over a region of 1% to 40% of the blade spacing. The air-conducting elements therefore leave an open flow passage between two blades and the hub, in which open flow passage the hub flow and the blade flow are directed in a controlled manner. The stabilizers in the blade root region segregate the hub flow and blade flow on the suction side of the blades and prevent flow separation and a harmful vortex formation.

Fin-like air-conducting elements are known per se, to be precise as "boundary-layer fences" from DE 26 14 318 C2 or as "auxiliary vanes" from DE 27 56 880 C2. However, these boundary-layer fences or auxiliary vanes according to the prior art are arranged in the radially outermost region of the blades, i.e., in the blade-body tip region. These boundary-layer fences are intended to supply energy to the flow on the one hand and to prevent flow around the blade tips (from the pressure side to the suction side) on the other hand. In contrast, the stabilizers according to the present invention are arranged in the region close to the hub, i.e., in the blade root region.

According to a further embodiment of the invention, the circumferential extent of the stabilizers increases in the air-flow direction; the stabilizers are thus adapted to the thickness increase in the boundary-layer flow or the vortex formation. This applies in particular to the development, where the extent s is about 0.01 t to 0.05 t in the air-inflow region and up to 0.40 t in the air-outflow region with t being the blade spacing, i.e., the circumferential distance from the leading edge of one axial blade up to the leading edge of an adjacent axial blade.

According to further advantageous embodiments of the invention, the length of the stabilizers, as viewed in the air-flow direction, corresponds to the length of the axial blades, in which case the leading edge of the stabilizers may be offset slightly in the flow direction relative to the blade leading edge.

The surface of the stabilizers is preferably curved slightly outward in the radial direction, i.e., it is designed to be slightly concave. This measure also takes into account the course of the flow in the blade root region.

It is advantageous if the stabilizers are arranged in a radial region of 0 to 40% of the blade height H, preferably approximately 0 to 20%. The hub flow and the flow at the blade root can be influenced most effectively in this region.

In a further embodiment of the invention, the hub has a viscous coupling in its inner region. This viscous coupling has radially oriented cooling ribs on its front side. The cooling ribs produce an essentially radially oriented air flow, a "cooling-air flow".

According to a further embodiment, radial blade elements, (also called "flow dividers" according to DE '978), are assigned to each stabilizer. The radial blade elements reach with their leading edge into the radially oriented cooling-air flow and deflect the latter with relatively low losses to the pressure side of the blades, that is to say, into the region of the hub ramp.

According to a further embodiment, the outer surfaces of the radial blade element and of the hub ramp merge to form a common surface, so that a favorable course of the flow in the hub region is achieved.

According to a further embodiment, the surfaces of the stabilizer, of the radial blade element and of the hub ramp merge into one another, so that the blade root is surrounded on the pressure side and suction side by a common surface which produces an especially low-loss flow.

Description will now be made with reference to the non-limiting figures which follow.

FIG. 1 shows an axial-flow fan 1, here having eight essentially radially oriented fan blades 2 which are fastened to a hub 3. The fan 1 or more specifically, its hub 3, is fastened to a viscous coupling 4 which has radially running cooling ribs 4' and drives the fan 1 in the direction of arrow A. Stabilizers 5 and radial blade elements 6 are arranged in the region of the hub 3.

Figure 2:
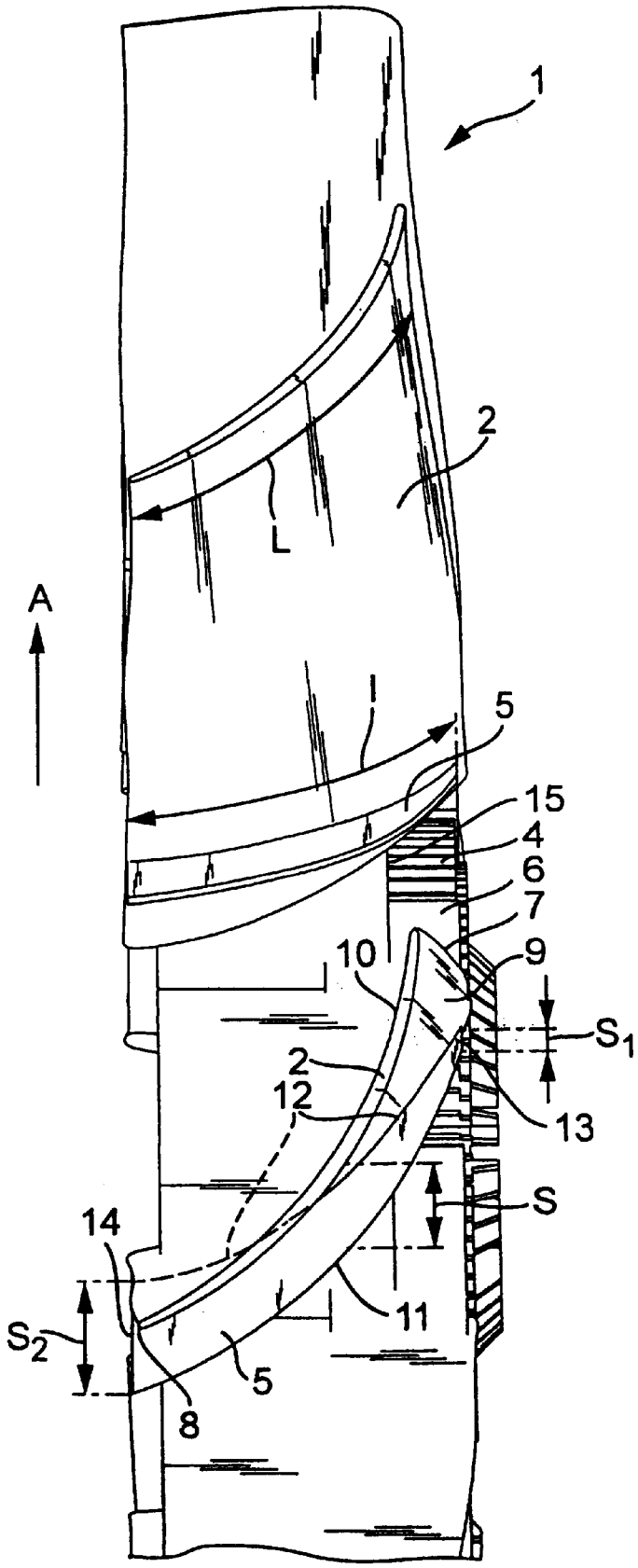
FIG. 2 shows the fan in a side view.

FIG. 2 shows a side view of the fan 1 with a view of the blade 2 along its radial longitudinal axis. This blade 2 has a leading edge or inflow edge 7, a trailing edge or outflow edge 8, and a suction side 9 and a pressure side 10. Arranged on the suction side 9 is the stabilizer 5, which is of fin-like design (or otherwise curved shape) and has an outer boundary line 11 and an inner boundary line 12 (where it is connected to the blade 2). The circumferential extent s of the stabilizer 5 increases from the inflow side ($s_1$) toward the outflow side ($s_2$), i.e. $s_2>s_1$. The length I of the stabilizer 5 approximately corresponds to the blade length L, a leading edge 13 of the stabilizer 5 being set back slightly relative to the blade leading edge 7, whereas a trailing edge 14 of the stabilizer 5 terminates approximately flush with the trailing edge 8 of the blade. In a preferred exemplary embodiment, the length L may be about 175 mm.

In one embodiment, the dimension $s_2$, at a blade spacing of $t=_{\pi}\cdot D:Z=_{\pi}\cdot 330:8_{\sim}130$ mm, is about 25–30 mm, i.e. about 20% of the blade spacing in the hub region (hub diameter $D_N$=330 mm).

In the front region of the hub 3, the radial blade element 6, which has also been designated as flow divider in DE '978, is arranged upstream of the blade leading edge 7 in the direction of flow (that is to say against the direction of rotation A). This radial blade element covers the front part of the viscous coupling 4 in the axial direction, whereas the leading edge 15 of the hub 3 is set back slightly in this region.

Figure 3:
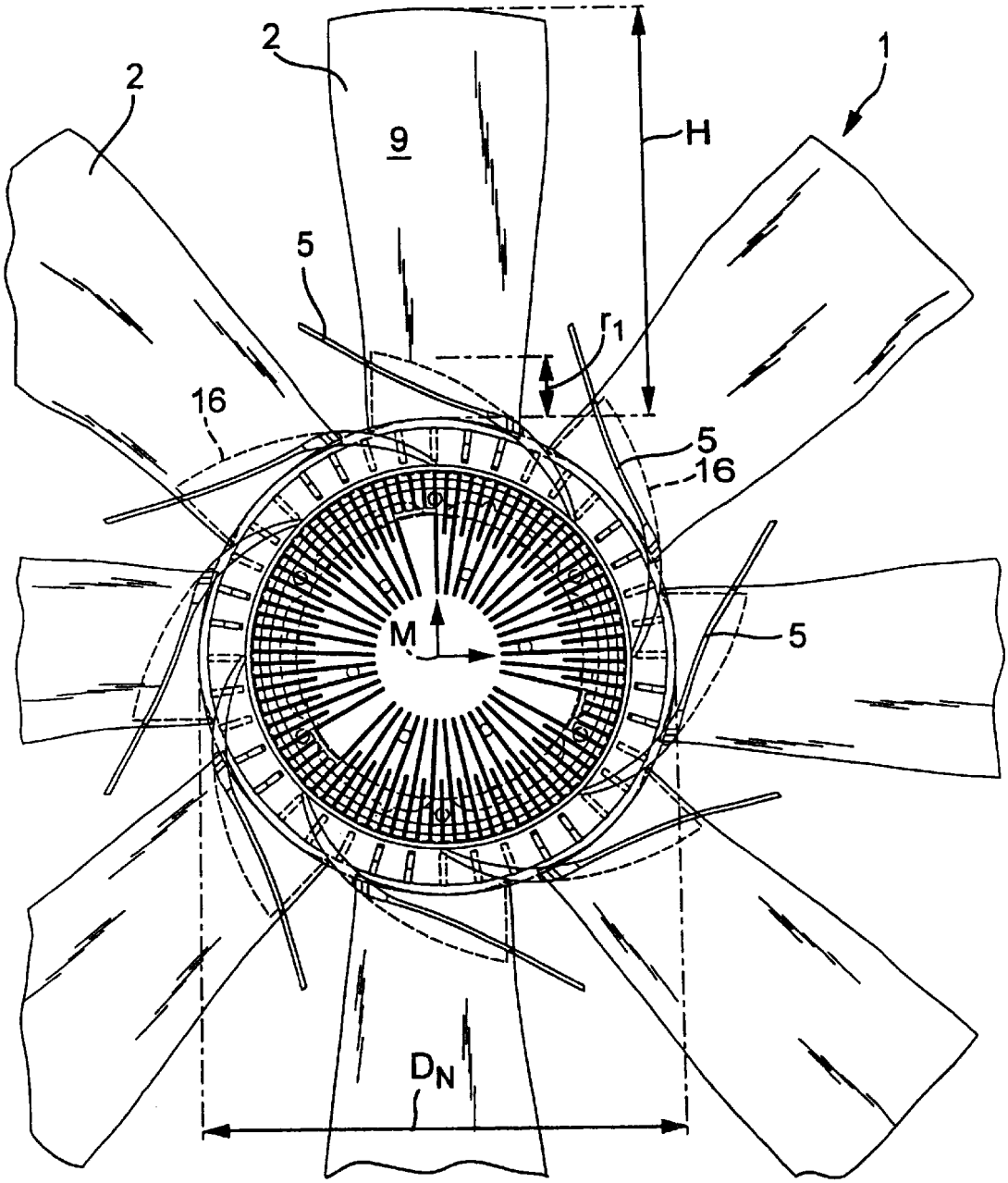
FIG. 3 shows the fan in a view from the front.

FIG. 3 shows a view of the fan 1 from the front, i.e., in the direction of the rotational axis M. The fan blades 2 have a radial extent or height H. This height H represents the radial length of each blade 2. The stabilizers 5 are arranged within a radial region from zero up to 40% of the blade height or radial length H, the stabilizers 5 being designed to be slightly concave, that is to say curved outward in the radial direction. In the preferred exemplary embodiment, the blade height H=210 mm at the already-mentioned hub diameter $D_N$=330 mm. The stabilizer extends radially over a region from about zero up to $r_1$=30 mm, i.e., 14% of the blade height or radial length H. It can also be seen from this representation of the stabilizers 5 that they are also demoldable in the axial direction (in the direction of the rotational axis M). This is especially advantageous when the fan is injection-molded as a plastic part or produced as a cast part. The broken lines 16 show the course of the hub ramp on the rear side (pressure side) of the blade 2.

Figure 4:
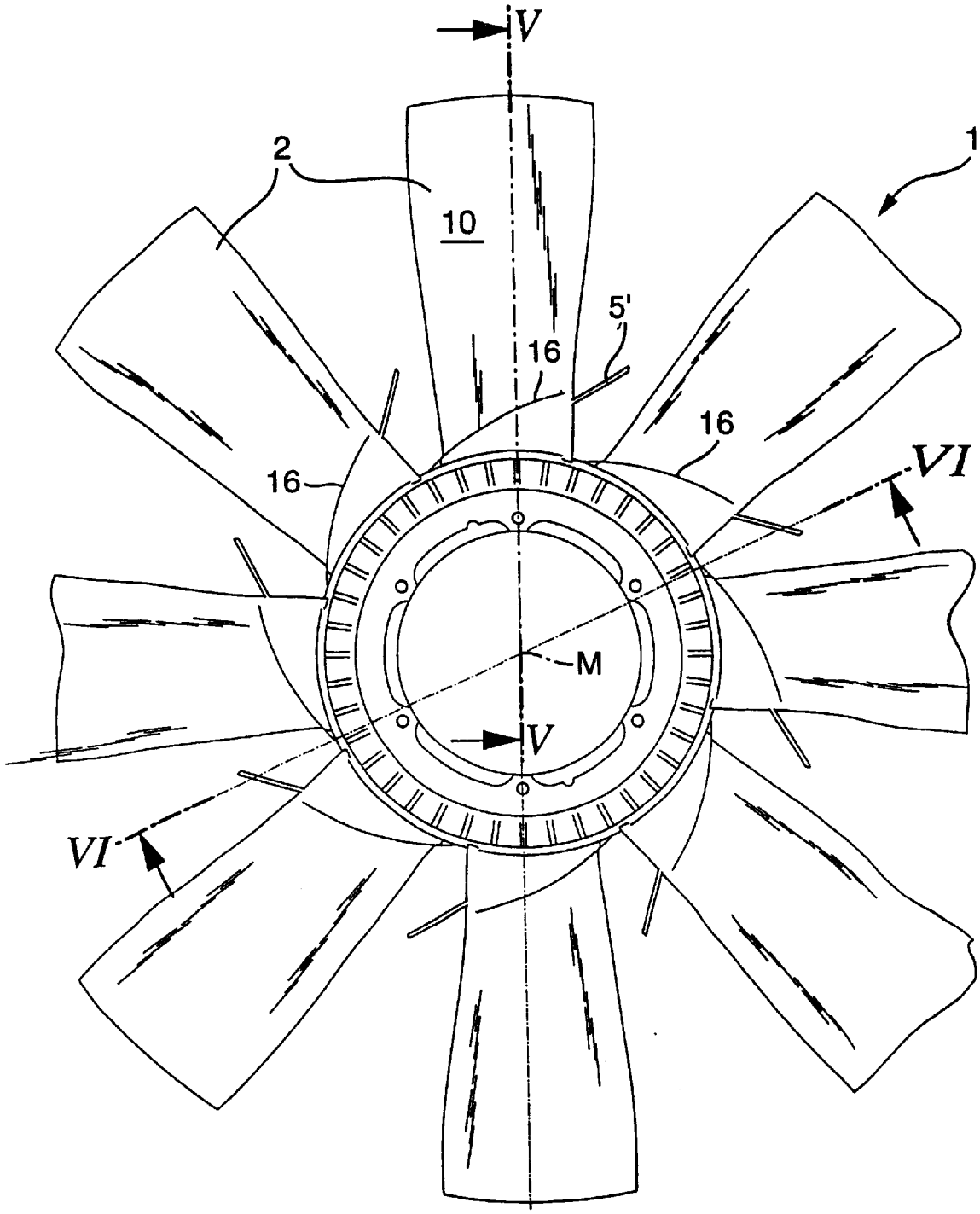
FIG. 4 shows the fan in a view from the rear.

FIG. 4 shows the fan 1 in a view from the rear, that is to say in the direction of the rotational axis M. The direction of view is therefore toward the pressure side 10 of the fan blades 2: the hub ramp is schematically indicated by the line 16 in the hub or blade root region. That part of the stabilizers 5 which projects beyond the trailing edge 8 of the fan blades 2 is designated by reference numeral 5'.

Figure 5:
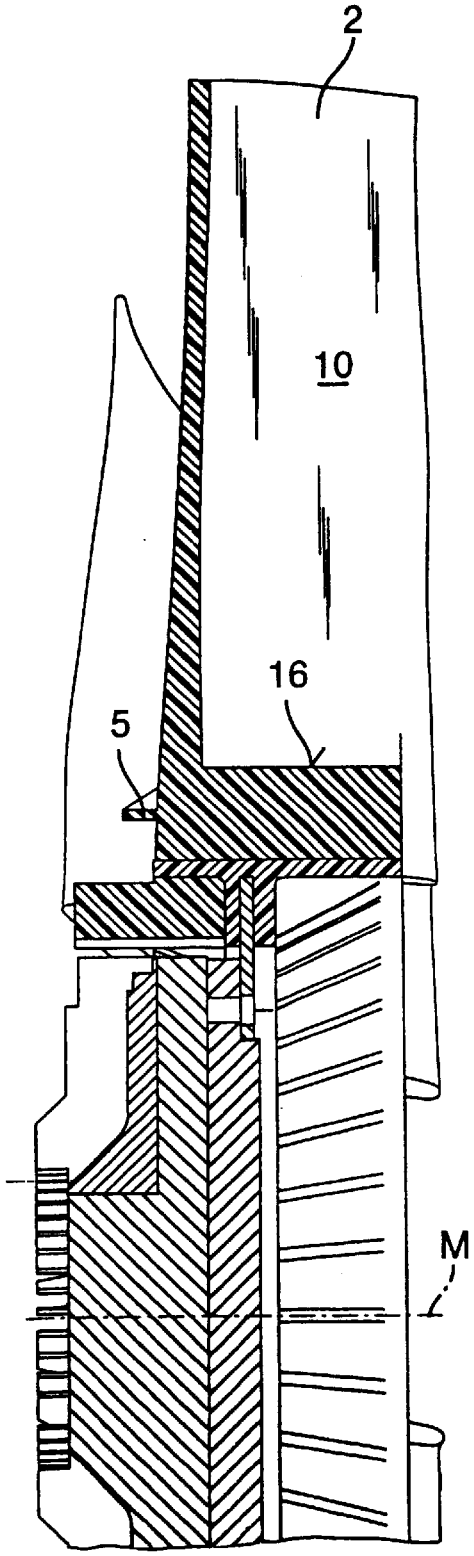
FIG. 5 shows an axial section through the fan in the plane V—V.

FIG. 5 shows an axial section through the fan 1 along line V—V in FIG. 4. In its left-hand region, that is to say, the suction-side region, the fan blade 2, which is injection-molded as a plastic part, has the stabilizer 5, which projects approximately at right angles and is molded onto the fan blade 2. The ease of demolding of the stabilizers 5 in the axial direction also becomes clear here. On the right-hand side of the blade, the top edge of the hub ramp is designated by the reference numeral 16.

Figure 6:
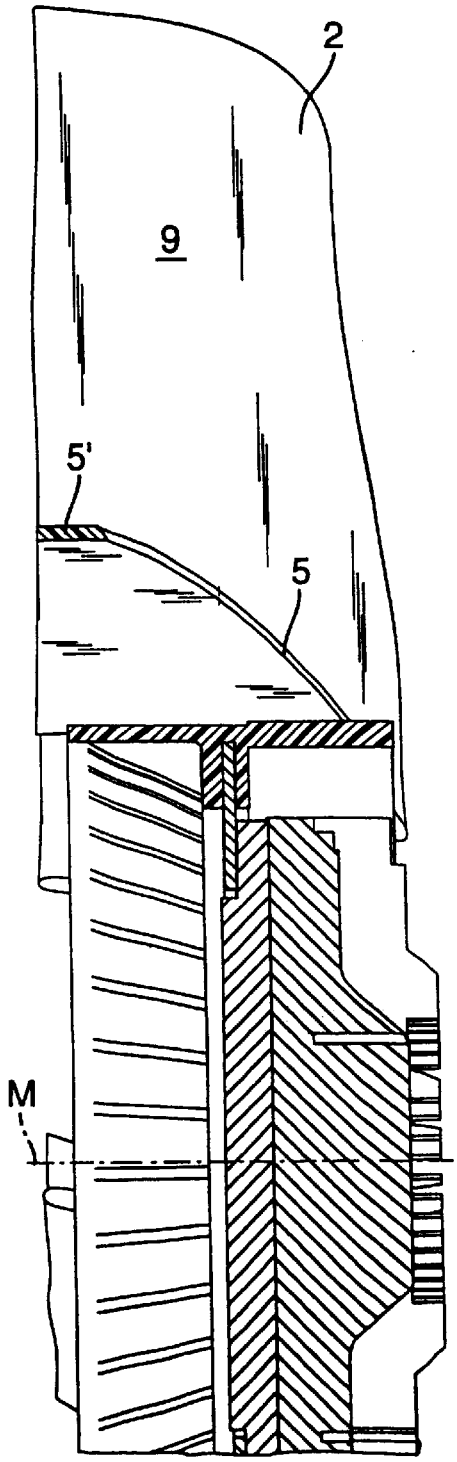
FIG. 6 shows an axial section through the fan in the plane VI—VI.

FIG. 6 shows a section along line VI—VI in FIG. 4 with a direction of view toward the suction side 9 of the blade 2. Here, too, the ease of demolding in the axial direction for the sectioned region 5' of the stabilizer 5 becomes clear.

Figure 7:
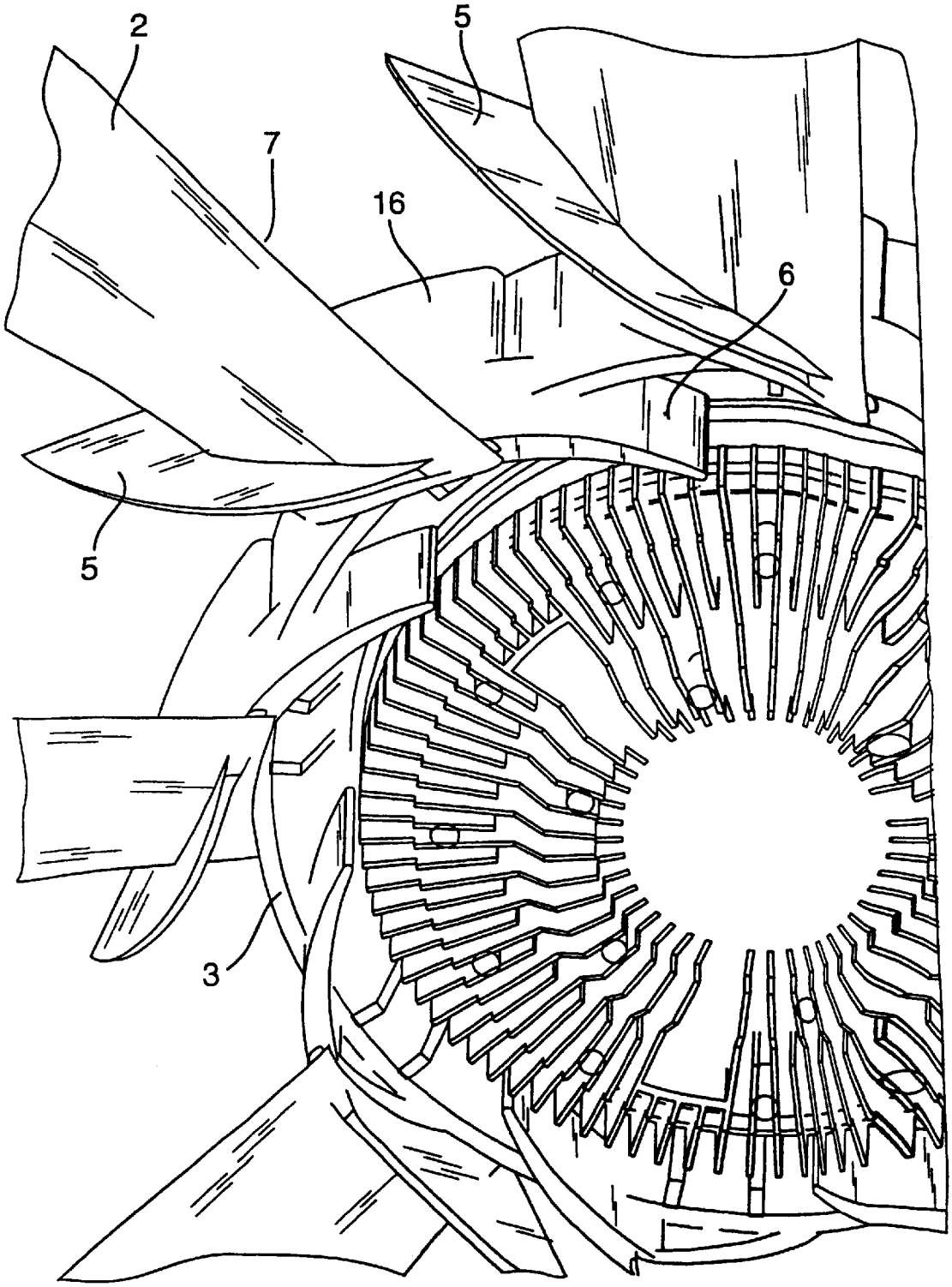
FIG. 7 shows an enlarged representation of the hub region.

FIG. 7 shows an enlarged representation, that is to say a partial view of FIG. 1, for the blade root region. The surfaces of the stabilizers 5, of the radial blade elements or flow dividers 6, and of the hub ramp 16 can again be clearly seen here. In this embodiment, the surface elements 5 and 6 are interrupted by the leading edge 7 of the blade 2.

Figure 8:
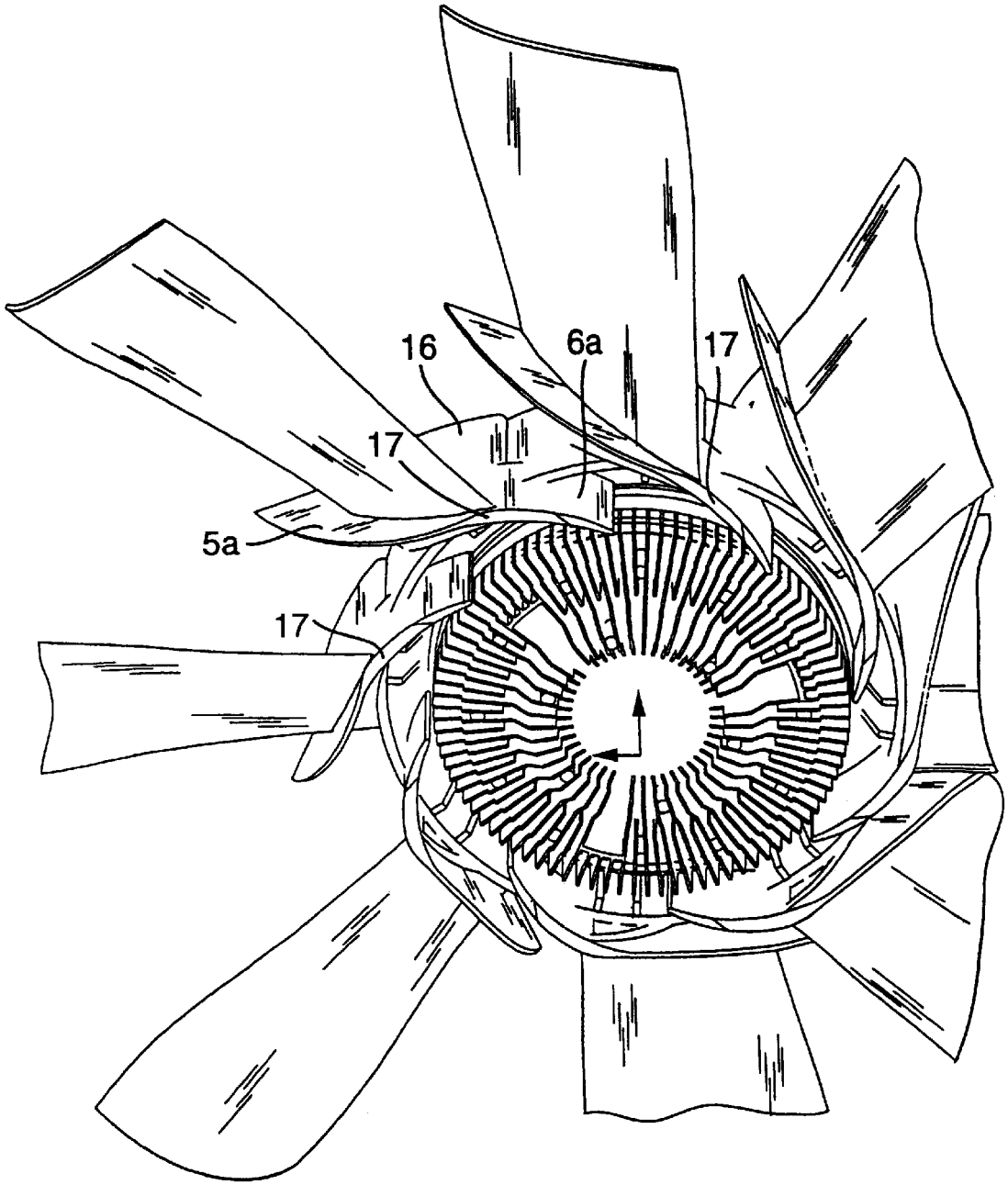
FIG. 8 shows a further embodiment of the stabilizers, integrated with flow dividers.

FIG. 8 shows a further exemplary embodiment in which the outer surfaces 5*a* and 6*a* of the stabilizers 5 and of the radial blade elements 6 are integrated with one another in such a way that they form a common surface, without a transition, with a common leading edge 17. The surface element 6*a* therefore merges with the surface 5*a* on the suction side of the blade 2 on the one hand and with the surface of hub ramp 16 of the hub ramp on the pressure side of the blade on the other hand. As a result, a low-loss flow around the blade root, that is to say in the hub region, is achieved, the essentially radially oriented cooling-air flow of the viscous coupling being brought together with the flow around the blade in a controlled manner. The output of this fan, in particular in combination with the coupling, can thus be improved.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

The entire disclosure of German Patent Application No.101 00 064.2, filed Jan. 2, 2001, the priority document for the present application, including the specification, claims, abstract and drawings, is hereby incorporated by reference.

As used herein and in the following claims, articles such as "the ," "a" and "an" can connote the singular or plural.

All documents referred to herein are specifically incorporated herein by reference in their entireties.

What is claimed is:

1. A fan comprising axial blades fastened to a fan hub, and air-conducting elements being arranged in the region of the hub and essentially on the suction side of the axial blades, wherein the air-conducting elements are designed as fin-like stabilizers, the extent s of which in the circumferential direction is in the range of $0.01\ t \leqq s \leqq 0.40\ t$, t being the blade spacing.

2. The fan as claimed in claim 1, wherein the stabilizers are arranged in a radial region r of $0 \leqq r \leqq 0.40$ H, H being the radial extent (height) of the blade.

3. The fan as claimed in claim 1, wherein the fan is for a radiator of a motor vehicle.

4. A motor vehicle comprising an internal combustion engine; a radiator for cooling the engine; and a fan for directing air against the radiator, said fan comprising a fan as defined by claim 1.

5. The fan as claimed in claim 1, wherein the extent s increases as viewed in the axial or air-flow direction.

6. The fan as claimed in claim 5, wherein the extent s is about 0.01 t to 0.05 t in the air-inflow region and up to 0.40 t in the air-outflow region.

7. The fan as claimed in claim 1, wherein a length I of the stabilizers corresponds approximately to a length L of the axial blades.

8. The fan as claimed in claim 7, wherein the leading edge of the stabilizers is offset in an air-flow direction relative to the leading edge of the blades.

9. The fan as claimed in claim 7, wherein the trailing edge of the stabilizers terminates flush with the trailing edge of the blade.

10. The fan as claimed in claim 1, further comprising a viscous coupling arranged inside the hub, the coupling having radially extending cooling ribs.

11. The fan as claimed in claim 10, further comprising a radial blade element, the radial blade element being arranged downstream of the stabilizer in the direction of rotation A of the fan and within the stabilizer in the radial direction.

12. The fan as claimed in claim 1, wherein the outer surface of the radial blade element merges into a hub ramp on the pressure side of the blade.

13. The fan as claimed in claim 1, wherein the outer surfaces of stabilizer and radial blade element merge into one another and have a continuous leading edge.

14. A fan, comprising:

a fan hub;

a plurality of axial blades connected to said fan hub spaced at a distance t along a circumferential direction of said fan hub, each of said blades having a tip region and a hub region, each of said blades further having a suction side and a pressure side; and a plurality of air-conducting stabilizers arranged on a suction side of said blades, respectively, in said hub region of said blade, wherein said air-conducting stabilizers extend in a circumferential direction in the range of 1% to 40% of said distance t.

15. The fan of claim 14, wherein said stabilizers have a generally curved shape.

16. The fan of claim 14, wherein said stabilizers have a fin-like shape.

17. The fan of claim 14, wherein said stabilizers increase in width along a direction of air flow.

18. The fan of claim 14, wherein said axial blades have a height H, and said stabilizers extend up to 40% of H.

19. The fan of claim 14, wherein said axial blades have a height H, and said stabilizers extend up to 20% of H.

20. The fan of claim 14, wherein said stabilizers have a length approximately equal to a length of said axial blades.

* * * * *